US006619207B1

(12) United States Patent
Claassen

(10) Patent No.: US 6,619,207 B1
(45) Date of Patent: Sep. 16, 2003

(54) SCREEN-PRINTING DEVICE WITH A CLEANING UNIT WHICH IS DISPLACEABLE INSIDE A STENCIL

(75) Inventor: Wilhelmus J. A. L. M. Claassen, Boxmeer (NL)

(73) Assignee: Stork Prints B.V., Boxmeer (NL)

( * ) Notice: Subject to any disclaimer, the term of this patent is extended or adjusted under 35 U.S.C. 154(b) by 0 days.

(21) Appl. No.: 09/566,280

(22) Filed: May 5, 2000

(30) Foreign Application Priority Data

May 7, 1999 (NL) ..... 1011993

(51) Int. Cl.[7] ..... B41F 35/00
(52) U.S. Cl. ..... 101/424; 101/116; 101/425
(58) Field of Search ..... 101/116, 119, 101/120, 424, 425

(56) References Cited

U.S. PATENT DOCUMENTS 5,775,218 A * 7/1998 Zimmer ..... 101/120
5,992,313 A * 11/1999 Zimmer ..... 101/120
6,101,936 A * 8/2000 Claassen ..... 101/119

FOREIGN PATENT DOCUMENTS

| | | |
|---|---|---|
| EP | 0 865 920 A2 | 9/1998 |
| NL | 1 005 308 C | 8/1998 |

* cited by examiner

*Primary Examiner*—Ren Yan
(74) *Attorney, Agent, or Firm*—Hoffman & Baron, LLP

(57) ABSTRACT

A screen-printing device for printing a substrate, comprising at least one printing station having a removable stencil, a printing-medium feed and a squeegee device, a cleaning unit which can be displaced to and fro in the stencil at least in the longitudinal direction, feed means for feeding cleaning liquid into the stencil, and discharge means for removing printing medium and/or cleaning liquid from the stencil. The discharge means comprise a suction nozzle for sucking printing medium and/or cleaning liquid out from the stencil, which nozzle is arranged on the displaceable cleaning unit and can be moved to and fro in the longitudinal direction inside the stencil together with this unit.

19 Claims, 3 Drawing Sheets

SCREEN-PRINTING DEVICE WITH A CLEANING UNIT WHICH IS DISPLACEABLE INSIDE A STENCIL

FIELD OF THE INVENTION

The invention relates to a screen-printing device for printing a substrate, comprising at least one printing station having a removable stencil, a printing-medium feed and a squeegee device, a cleaning unit which can be displaced to and fro in said stencil at least in a longitudinal direction, feed means for feeding cleaning liquid into said stencil, and discharge means for removing printing medium and/or cleaning liquid from said stencil.

BACKGROUND OF THE INVENTION

A screen-printing device of this nature is known from NL-C-1005308, which, in FIG. 6, shows a printing station of the device, having a removable stencil and a squeegee device arranged therein. The top side of the squeegee device forms a guide face over which a cleaning unit can be moved to and fro. The cleaning unit is provided with a plurality of spray heads which are directed at the stencil and at the squeegee device. The spray heads are intended to deliver a cleaning liquid during a cleaning operation. The cleaning liquid which is delivered removes the printing medium from the squeegee device and from the inside of the stencil, mixes with the residual printing medium and collects in the bottom of the stencil. The squeegee device is designed with integral discharge means which comprise a discharge channel extending over the entire length in the squeegee device and provided with a plurality of suction openings which lie next to one another and open out in the bottom of the stencil. During the cleaning operation, the discharge channel is connected to a suction installation, and the cleaning liquid, together with the residual printing medium, is sucked out of the bottom of the stencil.

A drawback of this known screen-printing device is that the discharge means do not always function as desired. The suction force varies for each suction opening. The discharge channel has to be connected to a relatively powerful suction installation in order for an adequate suction result to be obtained over the entire length of the stencil. One or more suction openings becoming blocked is a regular occurrence. To rectify this problem, the entire squeegee device has to be removed from the stencil. Another problem which is regularly encountered is that false air is already being sucked in at one of the suction openings, while liquids which are to be sucked out are still located in the area of the other suction openings. The squeegee device with integral discharge means is relatively expensive and complex to produce, and is relatively heavy and consequently difficult to handle.

SUMMARY OF THE INVENTION

The object of the present invention is to provide a screen-printing device in which these drawbacks are eliminated.

According to the invention, this object is achieved by means of a screen-printing device according to claim 1. The screen-printing device comprises one or more printing stations, each having a removable stencil and a squeegee device extending inside it. The screen-printing device comprises feed means for feeding cleaning liquid into the stencil, and discharge means for removing residual printing medium and/or cleaning liquid from the stencil. The discharge means are provided on a displaceable cleaning unit which can be moved to and fro in the longitudinal direction inside the stencil, and comprise a suction nozzle which can be connected to a suction installation. The cleaning unit advantageously enables the stencil to be gradually sucked empty in a very thorough and efficient way from the left to the right and vice versa. During a cleaning operation, cleaning liquid is fed to the stencil, and the cleaning unit, with the suction nozzle operating, is moved to and fro one or more times through the stencil. In the process, the entire capacity of the suction installation is converted in concentrated form into a strong suction force which is always acting on a relatively small part of the bottom of the stencil. There will be virtually no more blockages in the discharge means, and any such blockages can easily be repaired outside the stencil, without the entire squeegee device having to be removed from the stencil for this purpose. The squeegee device may be of more lightweight, less complex and less expensive design. This is advantageous in particular because it is often the case that a plurality of squeegee devices are used for each printing station. Sucking in false air no longer has an adverse effect on the suction results, but rather can in fact be used as an indicator that the cleaning unit should be displaced to the next part of the bottom.

BRIEF DESCRIPTION OF THE DRAWINGS

The invention will be explained in more detail with reference to the appended drawing, in which.

DESCRIPTION OF THE PREFERRED EMBODIMENTS

Figure 1:
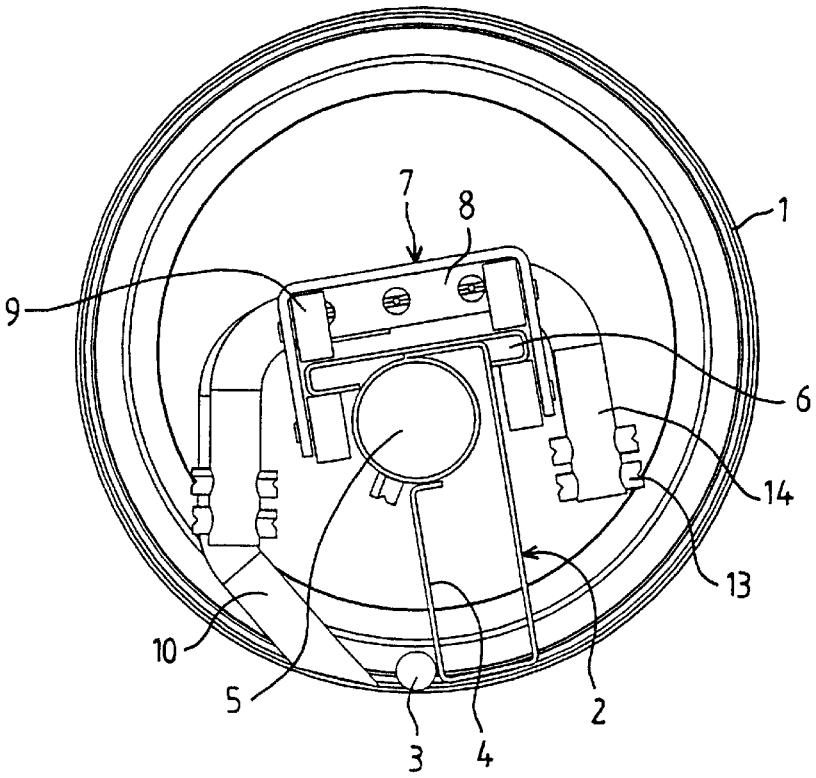
FIG. 1 shows a cross-sectional view of a printing station of a screen-printing device according to the invention, in a first position.

The printing station shown in FIG. 1 comprises a stencil 1 with a squeegee device 2 arranged therein. The squeegee device 2 comprises, in the customary way, a squeegee element 3, a support profile 4 and a printing-medium feed 5. The squeegee device 2 is provided, on the top side, with a guide profile 6, along which a cleaning unit 7 can be displaced to and fro. The cleaning unit 7 comprises a trolley 8 which can roll along the guide profile 6 on running wheels 9. In this case, the running wheels 9 lie on either side of the squeegee device 2 and bear against the profile 6 both at the top and the bottom. Consequently, the position of the cleaning unit 7 with respect to the squeegee device 2 is accurately defined.

The trolley 8 is provided with a tubular suction nozzle 10 which extends downwards inside the stencil 1. The suction nozzle 10 is intended to suck residual printing medium and/or cleaning liquid out of the stencil 1. This suction has to take place in particular during a cleaning operation, during which the stencil 1 and the squeegee device 2 are rinsed clean with the aid of cleaning liquid. The suction nozzle 10 opens out substantially at the lowest point in the stencil 1. As a result, it is possible to suck virtually all the liquids out of the bottom of the stencil 1.

The squeegee device 2, together with the cleaning unit 7 which is guided over it, and the stencil 1, can be vertically adjusted with respect to one another. In an operating position (FIG. 1), the suction nozzle 10 opens out substantially in the vicinity of the lowest point in the stencil 1. In an at-rest position (FIG. 2), the squeegee device 2 together with cleaning unit 7 and suction nozzle 10 is clear of the stencil 1, so that the stencil 1, the squeegee device 2 and the cleaning unit 7 can be removed without damaging one another.

The cleaning unit can be introduced both in the at-rest position and in the operating position of the squeegee device. A washing cycle, consisting of feeding cleaning liquid and sucking out printing medium, may in principle be carried out both in the operating position and in the at-rest position.

In a variant, the suction nozzle may be provided at the end of a flexible hose. This provides the freedom to pass the cleaning unit through an end ring of the stencil, which end ring may have a passage which is smaller than the cleaning unit with flexible hose and suction nozzle.

Figure 2:
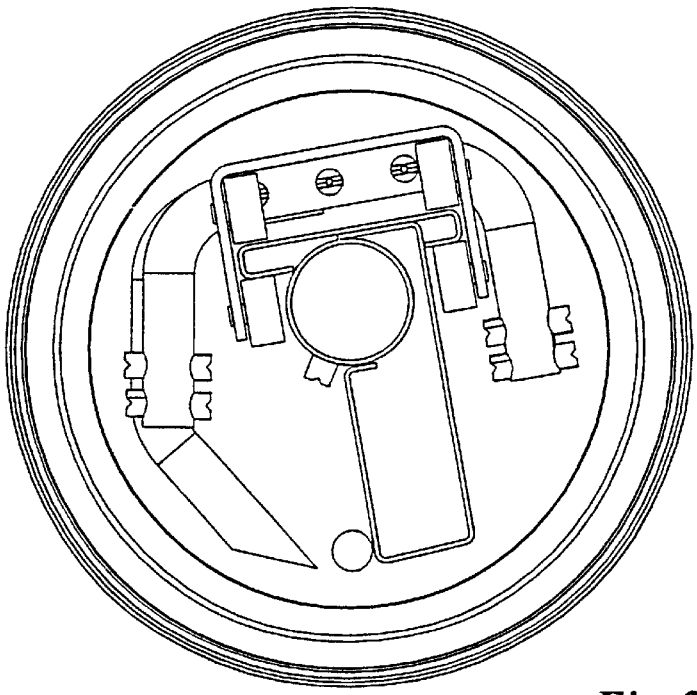
FIG. 2 shows a view corresponding to FIG. 1, in a second position.

In FIGS. 1 and 2, the suction nozzle 10 is provided on that side of the squeegee device 2 to which the printing medium is also fed through the printing-medium feed 5 and where the squeegee element 3 is located. In the variant of the cleaning unit shown in FIG. 3, suction nozzles 31 are positioned on both sides of a trolley 30. In another variant, one or more suction nozzles are provided on the trolley only on that side of the squeegee device which lies opposite the squeegee element. The latter variant has the advantage that end partitions can be provided on the squeegee-element side of the squeegee device without these end partitions impeding the movements of the cleaning unit.

During a cleaning operation, cleaning liquid has to be fed to the stencil. This may, for example, be effected via a separate feed member which is introduced into the stencil, or via feed means which are integrated in the squeegee device. In a preferred embodiment, however, a plurality of spray heads 13 are provided on the cleaning unit 7. As can be seen from FIG. 1, the spray heads 13 are directed both at the stencil 1 and at the squeegee device 2. The spray heads 13 are arranged at the ends of pipes 14 which are connected to the trolley 8. The feeding of cleaning liquid and the suction of residual printing medium mixed with the cleaning liquid may advantageously take place in a single displacement operation of the cleaning unit 7.

The spray heads 13 may also be used to deliver air, by means of which the stencil 1 can be blown dry after a cleaning operation. In a variant, the cleaning unit is provided with separate distributor heads for delivering air.

In the embodiment shown in FIG. 1, the printing-medium feed 5 is integrated in the squeegee device 2. In a variant, however, the printing-medium feed is also provided on the displaceable cleaning unit, so that it is possible to meter printing medium into the stencil during a traversing movement. This allows very accurate metering to be achieved.

The cleaning unit may be fitted with a level detector for measuring the amount of printing medium during a printing process or the amount of cleaning liquid during a cleaning operation. The measurement data derived from the level detector can be used to control the displacement speed of the cleaning unit, the suction force from the suction installation and/or the pressure of the printing-medium feed.

The displaceable cleaning unit may furthermore be provided with a homogenizer element, for example a stirrer blade which extends downwards in the stencil, for homogenizing, such as mixing, distributing or smoothing, of the printing medium in the stencil during or prior to a printing process. Advantageously, the suction nozzle 10 which extends down to the bottom of the stencil 1 may also form the homogenizer element.

In particular, the displaceable cleaning unit is fitted with a camera, by means of which the situation in the stencil can be monitored during a printing process.

Figure 3:
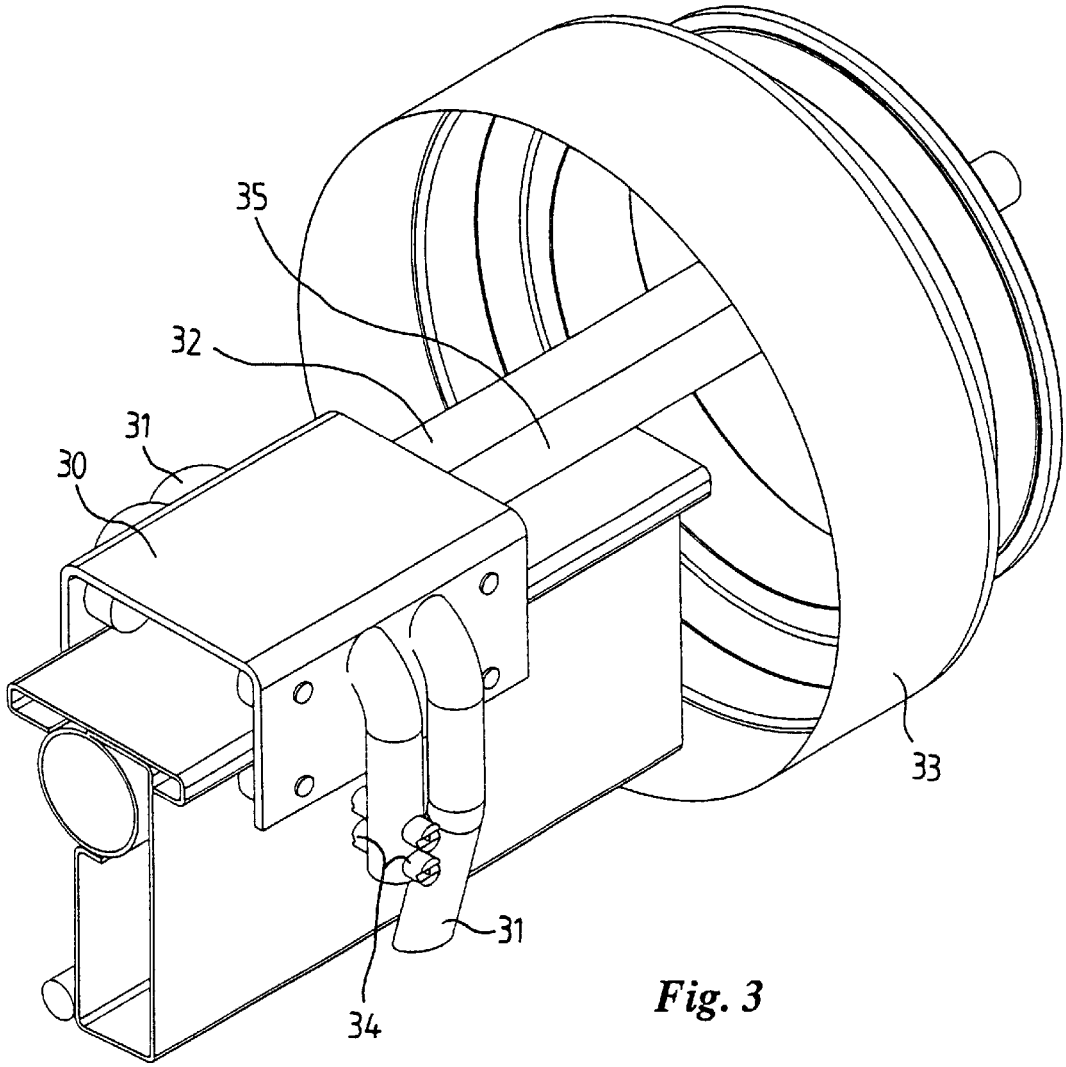
FIG. 3 shows a diagrammatic, perspective view of one end of a stencil in which there are a squeegee device and a displaceable cleaning unit according to the invention.

In the embodiment shown in FIG. 3, only one end of the stencil is shown, for the sake of clarity. The abovementioned suction nozzles 31 are connected, at the rear side of the trolley 30, to a discharge hose 32 for discharging liquids which have been sucked in to outside the stencil 33. For this purpose, the discharge hose 32 is to be connected to a suction installation. The trolley also comprises a plurality of spray heads 34 which, at the rear side of the trolley 30, are connected to a feed hose 35 for feeding cleaning liquid. For this purpose, the feed hose 35 is to be connected to a cleaning-liquid reservoir.

Figure 4:
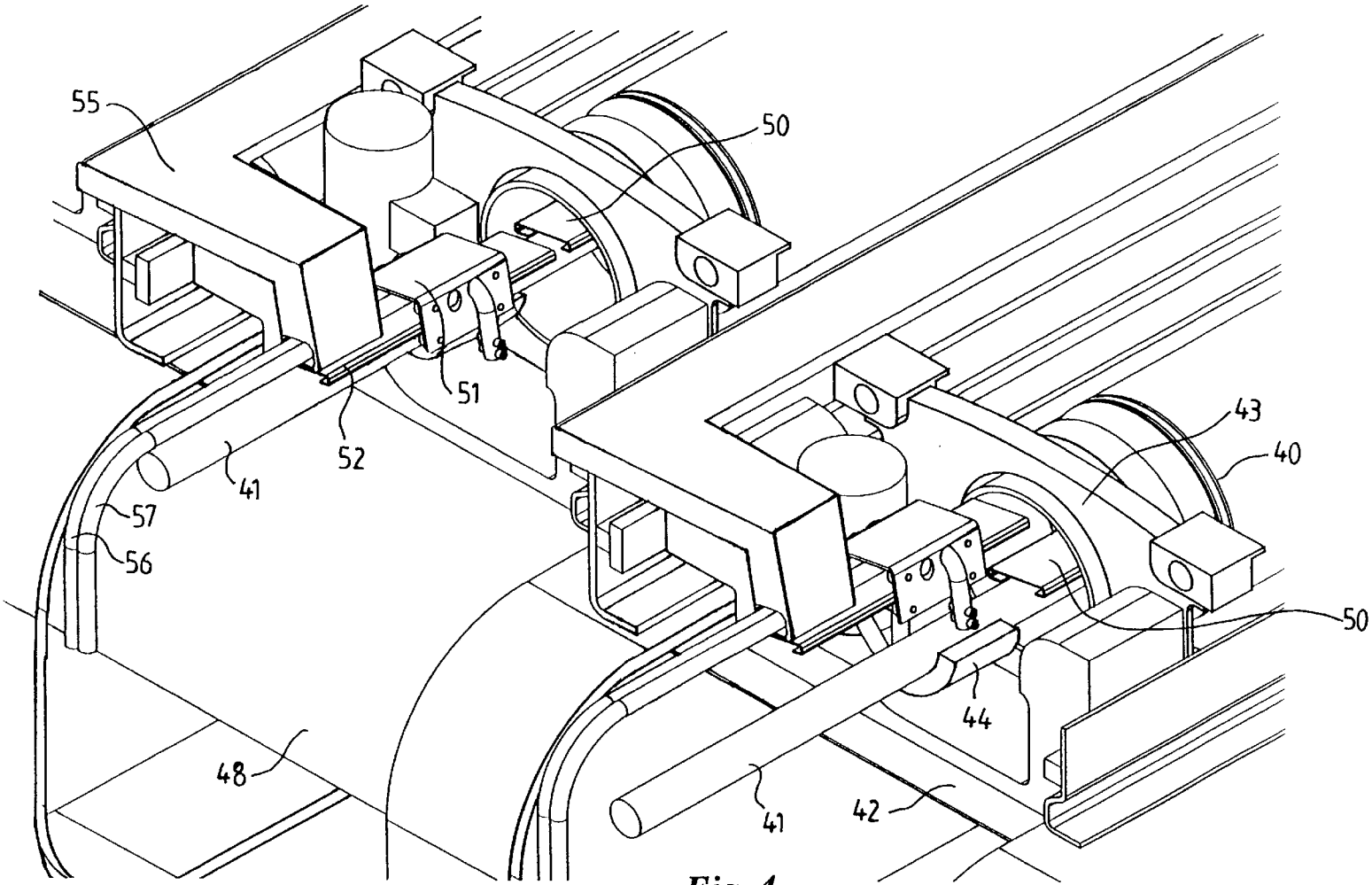
FIG. 4 shows a perspective view of a side part of a screen-printing device according to the invention.

FIG. 4 shows a part of an embodiment of the screen-printing device according to the invention which lies at the side. Two adjacent printing stations, each with a removable stencil 40 and a squeegee device 41 extending therein can be seen. The stencil 40 and the squeegee device 41 are vertically adjustable with respect to a substrate 42 which is to be printed and can be passed through beneath the printing stations. To this end, the stencil 40 is supported in a vertically adjustable stencil mount 43, while the squeegee device 41 is supported by a vertically adjustable squeegee suspension 44. In the left-hand printing station, the stencil 40 and the squeegee device 41 are shown in a raised at-rest position. In the right-hand printing station, the stencil 40 and the squeegee device 41 have been moved into a lowered printing position. For each printing station, a displaceable collecting shield 48 is provided, which can move between a parking position and a shielding position. The shielding position, in which the collecting shield 48 is arranged between the stencil 40 and the substrate 42 which is to be printed, is shown in the left-hand printing station. In this shielding position, the stencil 40 and/or the squeegee device 41 can be cleaned at the printing station without there being any risk of contamination to the substrate 42 which is to be printed.

The top side of the squeegee device 41 is provided with a guide profile 50, along which a displaceable cleaning unit 51 can be moved to and fro. A parking position for the cleaning unit 51 is provided to the side of each printing station. The parking position is formed by a separate guide rail 52. In the raised position of the squeegee device 41 in the left-hand printing station, the guide profile 50 lies at the same height as the guide rail 52. The cleaning unit 51 can then be moved out of its parking position into the stencil. The parking position has the considerable advantage that the stencil 40 and the squeegee device 41 can be removed freely from the screen-printing device independently of the cleaning unit 51. It is also possible for the cleaning unit 51 to be cleaned thoroughly in its parking position outside the stencil 40.

The guide rail 52 is fixed in position by a bent supporting bar 55 which is fixedly connected to the frame of the screen-printing device. The supporting bar 55 also forms a guide for feed and discharge hoses 56, 57 of the cleaning unit 51.

The cleaning unit according to the invention can be driven manually or automatically in order to be displaced to and fro in the longitudinal direction inside the stencil. The automatic driving of the cleaning unit may be effected in many ways. In a preferred embodiment, the drive means are formed by the feed and/or discharge hoses of the cleaning unit. Preferably, at least one of the hoses is rigid enough to enable the cleaning unit to be pushed forwards and pulled back by this hose. The hose may, for example, be driven by being clamped between two rollers, at least one of which is driven. Variants of the drive means may, for example, include pusher chains, rack-and-gear drives, spindle drives or piston-cylinder drives. The return movement of the cleaning unit may in all cases be provided by a spring or a weight attached to a separate cable.

In a particular embodiment, the discharge means arranged on the cleaning unit also comprise a scraper member. The scraper member may, for example, be formed by a plate which extends from the cleaning unit on one or both sides of the squeegee device and, while the cleaning unit is being moved inside the stencil, pushes printing medium and cleaning liquid in front of it. The suction nozzle can then advantageously suck out the residual printing medium and cleaning liquid which has been collected in front of the scraper member quickly and efficiently.

The cleaning unit may be provided with delimiting means which delimit the stencil on one side. This may be advantageous in particular in the parking position of the cleaning unit, in which the delimiting means delimit one end of the stencil and prevent printing medium from leaking out of the stencil. For this purpose, the cleaning unit may, for example, be provided with a delimiting wall, which in turn may be formed by the abovementioned scraper member. It is also possible for the suction nozzle to be connected to an air feed and, in the parking position, to blow the printing medium back into the stencil.

Consequently, the invention provides a screen-printing device having a displaceable cleaning unit with which it is possible for stencils and squeegee devices at the printing stations to be cleaned thoroughly. Advantageously, the cleaning unit is also used for a number of other functions, such as for the controlled feed of cleaning liquid, the traversing metering of a printing medium and the monitoring of a printing process. In addition to the embodiments shown and described, numerous variants are also conceivable. In one variant, the displaceable cleaning unit is not guided along the top side of a squeegee device, but rather a separate guide means, for example a guide rail, is provided, extending in the longitudinal direction inside the stencil. The separate guide means have the advantage that a cleaning operation on a stencil and removal and, if desired, replacement of a squeegee device can take place simultaneously. In addition to the trolley provided with running wheels, the cleaning unit may also comprise a carriage which can be slid along guide means. The cleaning unit and/or the suction nozzle may be designed in such a manner that they can be moved to and fro through the stencil not only in the axial direction but also in a direction which is transverse with respect to the latter. The residual printing medium can be recovered from the cleaning liquids which are sucked out. In addition to the roller squeegee which is shown, the displaceable cleaning unit can also be used for any other type of squeegee.

What is claimed is:

1. Screen-printing device for printing a substrate, comprising:

at least one printing station having a removable stencil, a printing-medium feed and a squeegee device;

a cleaning unit which can be displaced to and fro in said stencil at least in a longitudinal direction;

feed means for feeding cleaning liquid into said stencil; and discharge means for removing printing medium and/or cleaning liquid from said stencil;

wherein said discharge means comprise a suction nozzle for sucking printing medium and/or cleaning liquid out of said stencil, which nozzle is arranged to move to and fro in the longitudinal direction inside said stencil during cleaning operation of said screen-printing device.

2. Screen-printing device according to claim 1, in which said suction nozzle opens out substantially in the vicinity of a lowest point in said stencil.

3. Screen-printing device according to claim 1, in which said printing station is provided with guide means which extend through said stencil for guiding said displaceable cleaning unit.

4. Screen-printing device according to claim 3, in which said guide means comprise a guide profile which is part of said squeegee device.

5. Screen-printing device according to claim 3, in which said displaceable cleaning unit is provided with guide wheels.

6. Screen-printing device according to claim 3, in which a parking position is provided for said displaceable cleaning unit substantially outside said stencil.

7. Screen-printing device according to claim 6, in which said parking position comprises a guide rail which is connected to said guide means in said stencil.

8. Screen-printing device according to claim 1, in which said suction nozzle is connected to a discharge hose for discharging printing medium and/or cleaning liquid which has been sucked up to outside said stencil.

9. Screen-printing device according to claim 1, in which said displaceable cleaning unit is provided with one or more spray heads for delivering a cleaning liquid.

10. Screen-printing device according to claim 1, in which said displaceable cleaning unit is provided with a homogenizer element for homogenizing printing medium in said stencil during or prior to a printing process.

11. Screen-printing device according to claim 10, in which said suction nozzle forms said homogenizer element.

12. Screen-printing device according to claim 1, in which a parking position is provided for said displaceable cleaning unit substantially outside said stencil.

13. Screen-printing device according to claim 1, in which said displaceable cleaning unit is provided with one or more distributor heads for delivering air.

14. Screen-printing device according to claim 1, in which said printing-medium feed is provided on said displaceable cleaning unit.

15. Screen-printing device according to claim 1, said cleaning unit further comprising means for guiding and displacing the cleaning unit to and fro in a longitudinal direction in the stencil, and comprising a suction nozzle for sucking printing medium and/or cleaning liquid out of the stencil.

16. Screen-printing device according to claim 1, said squeegee device further comprising guide means for extending along the squeegee device, for guiding and displacing the cleaning unit to and fro along the squeegee device.

17. Screen-printing device according to claim 1, wherein said suction nozzle is arranged on said cleaning unit for movement together therewith.

18. Screen-printing device for printing a substrate, comprising:

at least one printing station having a removable stencil having a predetermined length, a printing-medium feed and a squeegee device;

a cleaning unit which can be displaced to and fro in said stencil at least in a longitudinal direction substantially over the length of said stencil;

feed means for feeding cleaning liquid into said stencil; and discharge means for removing printing medium and/or cleaning liquid from said stencil, said discharge means comprising one or more suction nozzles for sucking printing medium and/or cleaning liquid out of said stencil, said one or more nozzles being movable to and fro in the longitudinal direction inside said stencil substantially over the length of said stencil during cleaning operation of said screen-printing device.

19. Screen-printing device according to claim 18, wherein said one or more suction nozzles are arranged on said cleaning unit for movement together therewith.

* * * * *